US011697144B2

(12) United States Patent
Akashi et al.

(10) Patent No.: US 11,697,144 B2
(45) Date of Patent: Jul. 11, 2023

(54) MANUFACTURING APPARATUS AND MANUFACTURING METHOD OF HOT-ROLLED COIL

(71) Applicant: NIPPON STEEL CORPORATION, Tokyo (JP)

(72) Inventors: Tooru Akashi, Tokyo (JP); Seiji Arizumi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 37 days.

(21) Appl. No.: 17/439,314

(22) PCT Filed: Mar. 19, 2020

(86) PCT No.: PCT/JP2020/012373
§ 371 (c)(1),
(2) Date: Sep. 14, 2021

(87) PCT Pub. No.: WO2020/196293
PCT Pub. Date: Oct. 1, 2020

(65) Prior Publication Data

US 2022/0152679 A1 May 19, 2022

(30) Foreign Application Priority Data

Mar. 22, 2019 (JP) ..... 2019-054469

(51) Int. Cl.
*B21C 47/02* (2006.01)
*B21C 47/28* (2006.01)

(52) U.S. Cl.
CPC ..... *B21C 47/02* (2013.01); *B21C 47/28* (2013.01)

(58) Field of Classification Search
CPC ..... B21C 47/02; B21C 47/04; B21C 47/28; B21B 25/00
USPC ..... 72/148
See application file for complete search history.

(56) References Cited

U.S. PATENT DOCUMENTS 3,122,337 A * 2/1964 Boron ..... B21C 47/26 242/612

FOREIGN PATENT DOCUMENTS

| | | | |
|---|---|---|---|
| EP | 0 826 436 | A1 | 3/1998 |
| JP | 59-31827 | A | 2/1984 |
| JP | 63-243226 | A | 10/1988 |
| JP | 9-57344 | A | 3/1997 |
| JP | 9-327702 | A | 12/1997 |
| JP | 10-128445 | A | 5/1998 |

(Continued)

*Primary Examiner* — Teresa M Ekiert
(74) *Attorney, Agent, or Firm* — Birch, Stewart, Kolasch & Birch, LLP

(57) ABSTRACT

Flatness of a hot-rolled steel sheet in a coil is improved when the hot-rolled steel sheet is wound with a mandrel in a hot-rolling process to manufacture a coil. The mandrel has a protruding shape with a center portion in an axial direction protruding from both end portions when seen from a lateral side in the axial direction. Regarding a peripheral length difference, which is a difference between a peripheral length of the center portion of the mandrel and a peripheral length at a predetermined distance from the center portion, the ratio of the peripheral length difference to the peripheral length of the center portion is preferably 0.0002 to 0.012. The protruding shape may be a trapezoidal shape or a polynomial function shape.

8 Claims, 7 Drawing Sheets

(56) References Cited

FOREIGN PATENT DOCUMENTS

| | | | |
|---|---|---|---|
| JP | 4262142 | B2 | 5/2009 |
| JP | 2019-18209 | A | 2/2019 |

* cited by examiner

MANUFACTURING APPARATUS AND MANUFACTURING METHOD OF HOT-ROLLED COIL

TECHNICAL FIELD

Cross-Reference to Related Application

This application is based upon and claims the benefit of priority of the prior Japanese Patent Application No. 2019-054469, filed in Japan on Mar. 22, 2019, the entire contents of which are incorporated herein by reference.

The present invention relates to a manufacturing apparatus and a manufacturing method of a coil by winding a hot-rolled steel sheet with a mandrel in a hot-rolling process.

BACKGROUND ART

The hot-rolled steel sheet after finish rolling in the hot-rolling process is cooled to a predetermined temperature by a cooling device while being conveyed by a run-out table from a finishing mill to a coiler and then wound up in the coiler (mandrel) to be manufactured as a coil (hot-rolled coil).

The coils manufactured as described above are once wound at a predetermined winding temperature and then conveyed to a coil yard, where they are cooled to room temperature and then shipped to users or conveyed to a next process. At this time, flatness of the hot-rolled steel sheet may be poor when the coil to be shipped or conveyed to the next process is unwound for processing. In such a case, it is necessary to correct a shape of the hot-rolled steel sheet because it meanders due to poor sheet-passing ability, and problems such as squeezing occur during processing and rolling. However, since the shape (flatness) of the hot-rolled steel sheet is not known in a state of the coil, coils with a flatness specification that cannot be shipped with poor flatness are conveyed to a precise process for correction, regardless of whether the shape is good or bad, which is costly. Therefore, the flatness of the hot-rolled steel sheet in the wound state as a coil is required to be within a standard value in advance to convey only the hot-rolled steel sheet with a bad shape to the precise process. It is important to develop a technology to reduce the sheet passages to correct the shape in the precise process, especially in conventional mills, mini-mills, and thin-slab processes that are targeted for hot finalization.

For example, Patent Document 1 discloses a method for predicting a shape of a hot-rolled steel sheet by separating residual stress in the hot-rolled steel sheet (metal sheet) into a stress component that is converted into a waveform during buckling and a stress component that remains in the hot-rolled steel sheet after buckling and using the stress component that is converted into the waveform. In this shape prediction method, the waveform of the hot-rolled steel sheet generated after finish-rolling is corrected by, for example, tension acting on the hot-rolled steel sheet when it is wound on the coiler so that the residual stress is ultimately generated by temperature distribution in a width direction of the hot-rolled steel sheet at the time of winding. Furthermore, based on the predicted shape, the flatness of the hot-rolled steel sheet is improved by controlling the temperature distribution in the width direction using, for example, an edge heater or edge mask.

PRIOR ART DOCUMENT

Patent Document

[Patent Document 1] Japanese Patent No. 4262142

DISCLOSURE OF THE INVENTION

Problems to be Solved by the Invention

However, when the inventors investigated the shape of the steel sheet after the hot-rolling process in detail, they found that there was deterioration in flatness that could not be clarified simply by predicting the shape using the residual stress (elongation-strain difference) caused by the temperature distribution of the hot-rolled steel sheet, as disclosed in Patent Document 1. It was also found that the flatness of the hot-rolled steel sheet could not be sufficiently improved simply by controlling the temperature distribution in the width direction based on the shape prediction result. Therefore, there is room for improvement in improving the flatness of the hot-rolled steel sheet.

The present invention has been made because of the above problems, and an object thereof is to improve flatness of a hot-rolled steel sheet in a coil when the coil is manufactured by winding the hot-rolled steel sheet with a mandrel in a hot-rolling process.

Means for Solving the Problems

To solve the above-mentioned problems, the inventors made keen investigations and clarified a mechanism of the flatness deterioration of the hot-rolled steel sheet after the hot-rolling process, and found that the flatness deterioration was concretely caused by a combination of two factors: a temperature factor and a tight winding factor. The first temperature factor is thermal strain caused by non-uniform temperature distribution in the width direction of the hot-rolled steel sheet just before it is wound on the coiler (mandrel), and this thermal strain becomes the elongation-strain difference (residual strain). The second tight winding factor is that the tension acting on the hot-rolled steel sheet when it is wound on the coiler (mandrel) is distributed non-uniformly in the width direction due to a crown generated in the hot-rolled steel sheet after finishing rolling, for example, and the tight winding under the non-uniform tension distribution causes plastic deformation of an inner peripheral portion of the coil, resulting in plastic strain, and this plastic strain becomes the elongation-strain difference (residual strain).

Of the two factors, the first factor, the temperature factor, has been considered as the factor for deteriorating flatness in the past, and countermeasures have been taken such as, for example, the shape prediction method disclosed in Patent Document 1 above. On the other hand, the second factor, the tight winding factor, was newly discovered by the inventors, who found that deformation caused by tight winding in a cold-rolling process also occurs in the hot-rolling process.

As a result of keen investigation regarding the flatness deterioration due to the tight winding factor, the inventors found that compressive stress acting on the mandrel of the coiler was also distributed non-uniformly in the width direction due to the non-uniform tension distribution acting on the hot-rolled steel sheet at an inner peripheral portion of the coil, and a diameter reduction amount of the mandrel became non-uniform in the width direction. Concretely, the diameter reduction amount at a center portion of the mandrel in the width direction is large and becomes small at an end portion in the width direction. Then, the hot-rolled steel sheet wound on the deformed mandrel has a peripheral length difference in the width direction, and the flatness of the hot-rolled steel sheet deteriorates.

The present invention is made based on such knowledge and is an apparatus for winding a hot-rolled steel sheet with a mandrel in a hot-rolling process to produce a coil, wherein the mandrel has a protruding shape with a center portion in an axial direction protruding from both end portions when seen from a lateral side in the axial direction.

When the hot-rolled steel sheet is wound on the mandrel as described above, even if a diameter reduction amount of the mandrel becomes non-uniform in a width direction, the mandrel can be made uniform in diameter in the width direction after the tight winding because the mandrel is made to protrude in the present invention in advance in anticipation of this non-uniform diameter reduction amount. Therefore, it is possible to improve the flatness of the hot-rolled steel sheet by suppressing a peripheral length difference in the width direction in the hot-rolled steel sheet wound on the mandrel.

In the manufacturing apparatus of the hot-rolled coil, regarding a peripheral length difference, which is a difference between a peripheral length of the center portion and a peripheral length at a predetermined distance from the center portion, the ratio of the peripheral length difference to the peripheral length of the center portion may be 0.0002 to 0.012. The ratio of the peripheral length difference to the peripheral length of the center portion may be 0.002 to 0.008.

In the manufacturing apparatus of the hot-rolled coil, the protruding shape may be a trapezoidal shape or a polynomial function shape.

Furthermore, the present invention according to another aspect is a manufacturing method of a hot-rolled coil using the above-mentioned manufacturing apparatus, characterized in that a hot-rolled steel sheet that is non-transformed or undergoing transformation, or after completion of transformation and is at a temperature of 700° C. or higher is wound with the above-mentioned mandrel to manufacture the coil.

Effect of the Invention

According to the present invention, since the mandrel is made to protrude in advance in anticipation of the non-uniform diameter reduction amount in the width direction of the mandrel due to the tight winding factor, the mandrel after tight winding can be made uniform in diameter in the width direction. Therefore, it is possible to suppress the peripheral length difference in the width direction in the hot-rolled steel sheet wound on the mandrel and improve the flatness of the hot-rolled steel sheet.

EMBODIMENTS FOR CARRYING OUT THE INVENTION

Embodiments of the present invention will be described below with reference to the drawings. In this specification and the drawings, duplicate explanations are omitted by appending the same code to elements that have substantially the same functional configuration.

<Hot-Rolling Facility>

Figure 1:
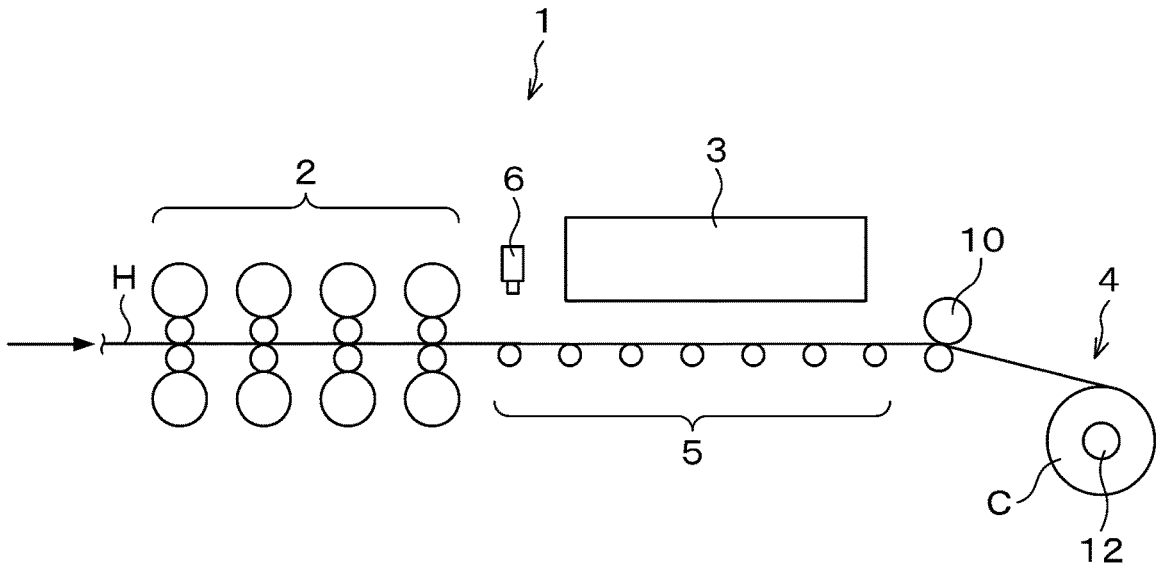
FIG. 1 is an explanatory diagram illustrating an outline of a configuration of a finishing mill and beyond in a hot-rolling facility.

First, a configuration of a hot-rolling facility according to the present invention will be explained. FIG. 1 is an explanatory diagram illustrating an outline of a configuration of a finishing mill 2 and beyond in a hot-rolling facility 1.

In the hot-rolling facility 1, the finishing mill 2 which continuously rolls a steel sheet H discharged from a heating furnace (not illustrated) and rolled by a roughing mill (not illustrated) to a predetermined thickness, a cooling device 3 which cools the steel sheet H after finish rolling (hereinafter, referred to as a hot-rolled steel sheet H) to a predetermined temperature, and a coiler 4 which winds up the cooled hot-rolled steel sheet H are provided in this order in a conveyance direction of the hot-rolled steel sheet H. A run-out table 5 is provided between the finishing mill 2 and the coiler 4 to convey the hot-rolled steel sheet H. The hot-rolled steel sheet H rolled by the finishing mill 2 is cooled by the cooling device 3 while being conveyed on the run-out table 5, and then wound by the coiler 4 to be manufactured as a coil C.

Between the finishing mill 2 and the cooling device 3 of the hot-rolling facility 1, a sheet-thickness gauge 6 is provided to measure a sheet thickness of the hot-rolled steel sheet H rolled by the finishing mill 2. The sheet-thickness gauge 6 can measure sheet thickness distribution in a width direction of the hot-rolled steel sheet H and measure a crown of the hot-rolled steel sheet H.

Figure 2:
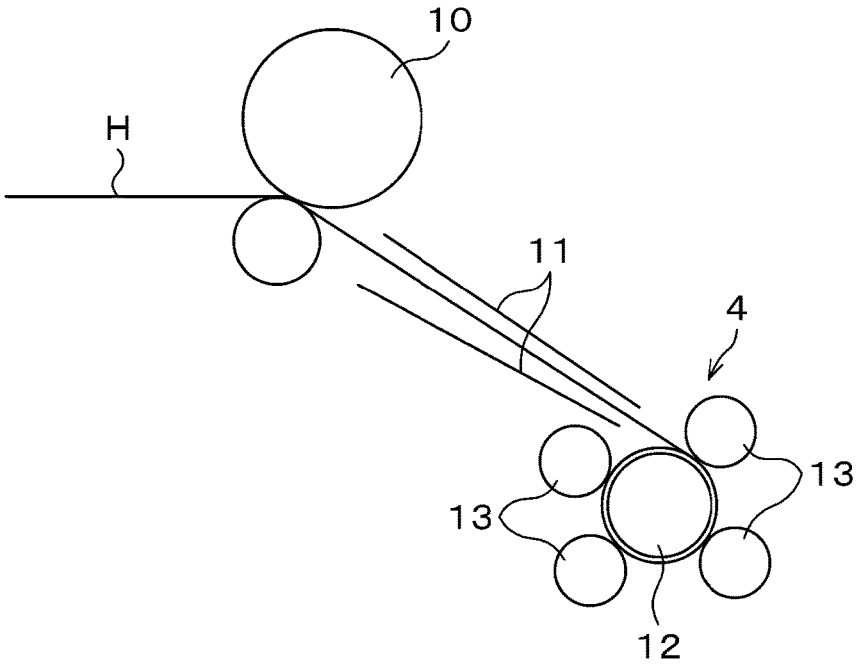
FIG. 2 is an explanatory diagram illustrating an outline of a configuration of a coiler.

FIG. 2 is an explanatory diagram illustrating an outline of a configuration of the coiler 4. An example in FIG. 2 illustrates a state of start of winding operation at the coiler 4. The coiler 4 has a pinch roll 10, a chute 11, a mandrel 12, and wrapper rolls 13.

In the coiler 4, the hot-rolled steel sheet H is bent by the pinch roll 10 in a direction of the mandrel 12 and passes through the chute 11. Here, the wrapper rolls 13 are closed (in contact with the mandrel 12) and stand by while rotating at a speed several percent faster than a steel sheet speed of each other before a tip of the hot-rolled steel sheet H reaches the mandrel 12. When the hot-rolled steel sheet H reaches the mandrel 12 and the wrapper rolls 13, the mandrel 12 and the wrapper rolls 13 sandwich and wind the hot-rolled steel sheet H. The mandrel 12 can expand and contract its diameter by a cylinder portion 24 as described below and starts expanding when the hot-rolled steel sheet H is wound on the coil C by the predetermined number of windings and stops expanding its diameter when a force of expansion is balanced with a force of tightening the coil C, and the wrapper rolls 13 open and move away from coil C.

Figure 3:
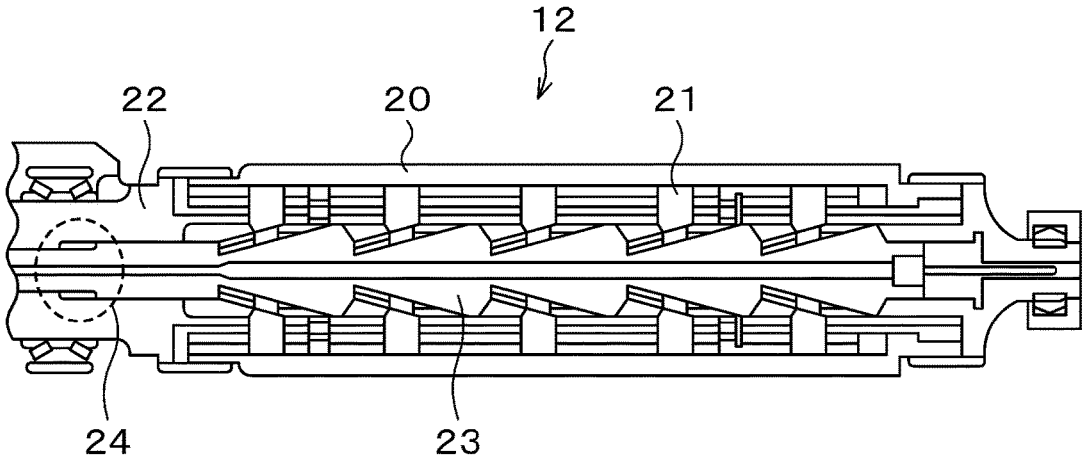
FIG. 3 is an explanatory diagram illustrating an outline of a configuration of a mandrel when seen from a cross-section in an axial direction.
Figure 4:
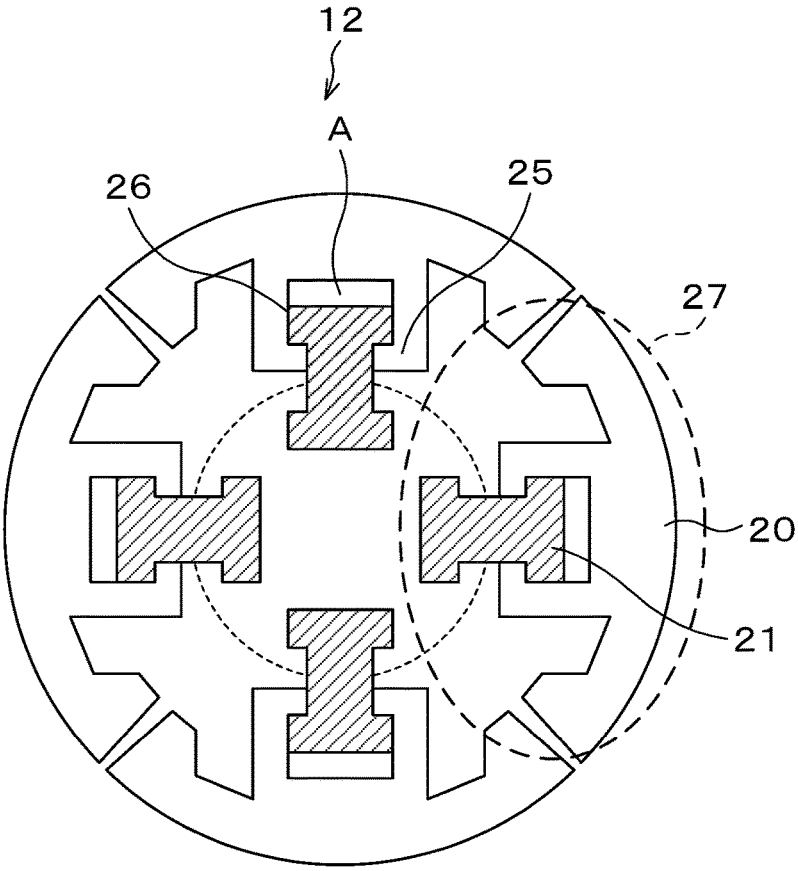
FIG. 4 is an explanatory diagram illustrating the outline of the configuration of the mandrel when seen from a cross-section in a direction orthogonal to an axis.

FIG. 3 and FIG. 4 are each an explanatory diagram illustrating an outline of a configuration of the mandrel 12. As illustrated in FIG. 3, the mandrel 12 is of a segment type and has mandrel segments 20, wedges 21, a slide rod 22, and a wedge shaft 23. Of these components, the slide rod 22 and the wedge shaft 23 constitute the cylinder portion 24. By sliding the wedges 21 by the cylinder portion 24, the mandrel segment 20 slides in a radial direction in expanding or contracting direction along a gradient on the wedge shaft 23.

As illustrated in FIG. 4, the mandrel 12 has a gap A between a segment flange portion 25 and a wedge jaw portion 26 and has a mechanism that the mandrel 12 expands due to the gap A eliminated by a centrifugal force when the mandrel 12 rotates. A segment-wedge portion 27 has a set of mandrel segment 20 and wedge 21, and the mandrel 12 is constituted by four sets of segment-wedge portions 27.

<Mechanism of Flatness Deterioration>

The present invention improves flatness of a hot-rolled steel sheet in a coil manufactured in a hot-rolling facility having the above configuration. A winding temperature of the hot-rolled steel sheet varies depending on material but ranges from approximately 100 to 800° C. A coil manufactured in the hot-rolling facility is conveyed to a coil yard, cooled to room temperature, and then unwound. The flatness to be improved in the present invention is the flatness of the hot-rolled steel sheet after the coil is unwound (more specifically, the flatness of the hot-rolled steel sheet due to a tight winding factor, as described below), and in such a case, an end portion in a width direction of the hot-rolled steel sheet has wave-like out-of-plane deformation called an ear wave. Here, the flatness deterioration that occurs in many hot-rolled steel sheets is the ear wave, and the present invention is intended to improve this ear wave.

Figure 5:
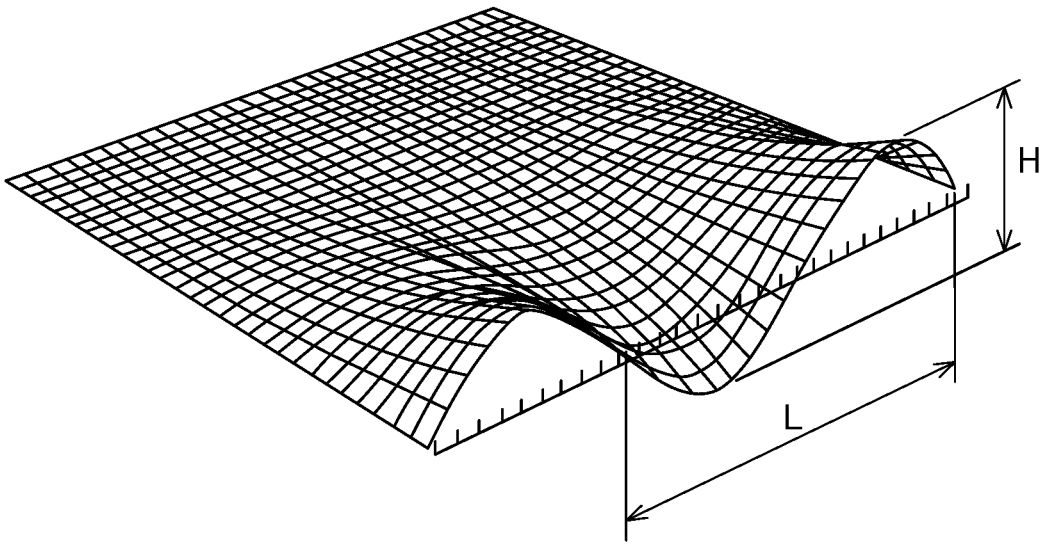
FIG. 5 is an explanatory diagram illustrating a definition of steepness representing a degree of an ear wave.

FIG. 5 is an explanatory diagram illustrating a definition of steepness, which expresses a degree of the ear wave. A steepness degree λ is expressed as a percentage by dividing a wave height H at the end portion in the width direction of the hot-rolled steel sheet by a wave pitch L and then multiplying by 100. The steepness degree λ is expressed in the following expression (1) using an elongation-strain difference Δε. This definition of the steepness degree is also applied to a medium wave that occurs at a center portion in the width direction of the hot-rolled steel sheet.

[Mathematical expression 1]

$$\lambda = \frac{H}{L} = \frac{2}{\pi}\sqrt{\Delta\varepsilon} \tag{1}$$

The inventors then conducted a keen investigation and clarified a mechanism of the flatness deterioration of the hot-rolled steel sheet after a hot-rolling process. In other words, it becomes clear that the flatness deterioration is caused by a combination of two factors: a temperature factor, which causes thermal strain due to non-uniform temperature distribution in the width direction of the hot-rolled steel sheet; and the tight winding factor, which causes plastic deformation of an inner peripheral portion of a coil due to the tight winding caused by non-uniform tension distribution in the width direction which occurs at the coiler winding time. These two factors are described below.

(Temperature Factor)

The first one is the flatness deterioration due to the temperature factor. The thermal strain is generated in the hot-rolled steel sheet just before it is wound on the coiler due to the non-uniform temperature distribution in the width direction. This thermal strain becomes the elongation-strain difference (residual strain), which causes the flatness deterioration (shape deterioration) of the hot-rolled steel sheet.

The flatness deterioration due to the temperature factor has been known for a long time and is disclosed, for example, in the above-mentioned Patent Document 1 and publicly known documents (September 2004, 148th Autumn Meeting of the Iron and Steel Institute of Japan, "Investigation of Flatness Prediction Method after Cooling of Hot-Rolled Steel Sheet," Akashi et al.), and the like. In other words, when a hot-rolled steel sheet that has been finish-rolled in a finishing mill is cooled by a cooling device while being conveyed on a run-out table, an elongation-strain difference is generated due to the non-uniform temperature distribution in the width direction. However, this elongation-strain difference becomes almost zero before and after the hot-rolled steel sheet passes through a lower pinch roll, due to the following corrective actions. For example, the hot-rolled steel sheet with tension applied by the coiler just before winding is passed through with an infinite radius of curvature in a sheet-passing direction until just before the lower pinch roll, but when the hot-rolled steel sheet passes through the lower pinch roll, it is wound around the lower pinch roll while tension is applied (surface contact), and bending deformation is forcibly applied at the radius of the lower pinch roll. After passing through the lower pinch roll, the deformation is corrected because the radius of curvature in the sheet-passing direction becomes infinite again. When the temperature distribution in the width direction of the hot-rolled steel sheet at the time of winding is lowered to a normal temperature at the time of unwinding of the coil, the elongation-strain difference is generated in the hot-rolled steel sheet, and the flatness deteriorates.

(Tight Winding Factor)

The second one is the flatness deterioration due to the tight winding factor. For example, the tension acting on the hot-rolled steel sheet when it is wound on the coiler is distributed non-uniformly in the width direction due to a crown generated in the hot-rolled steel sheet after finishing rolling. The tight winding under this non-uniform tension distribution causes plastic deformation of an inner peripheral portion of the coil, resulting in plastic strain. This plastic strain becomes the elongation-strain difference (residual strain) and causes the flatness deterioration (shape deterioration) of the hot-rolled steel sheet.

Figure 6:
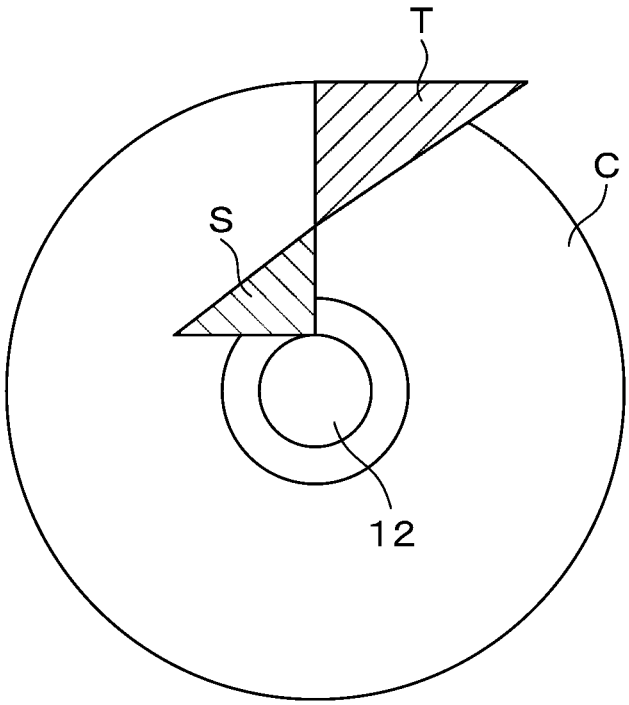
FIG. 6 is a conceptual diagram explaining a mechanism of flatness deterioration due to a tight winding factor.
Figure 7:
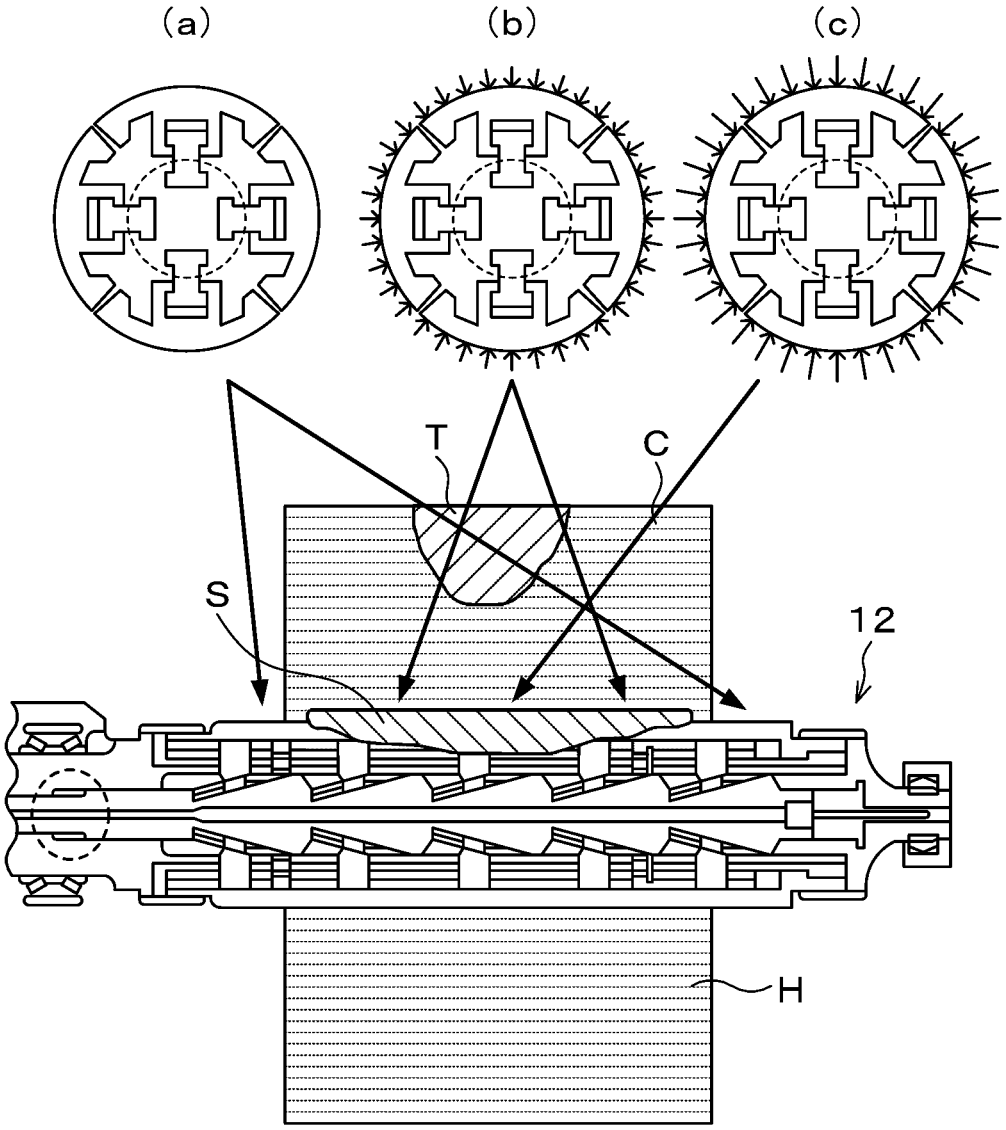
FIG. 7 is a conceptual diagram explaining the mechanism of the flatness deterioration due to the tight winding factor, where (a) illustrates compressive stress (zero) acting on an end portion in a width direction of the mandrel, (b) illustrates compressive stress (arrows in the drawing) acting between the end portion and a center portion in the width direction, and (c) illustrates compressive stress (arrows in the drawing) acting on the center portion in the width direction.

Next, a mechanism of the flatness deterioration due to the tight winding factor will be explained in detail using FIG. 6 and FIG. 7. Concretely, the flatness deterioration is caused by the following phenomena (A) to (D). In FIG. 6 and FIG. 7, a code T represents tensile stress and a code S represents compressive stress. In FIG. 7, (a) illustrates the compressive stress (zero) acting on an end portion in a width direction of a mandrel, (b) illustrates the compressive stress (arrows in the drawing) acting between the end portion and a center portion in the width direction, and (c) illustrates the compressive stress (arrows in the drawing) acting on the center portion in the width direction.

(A) First, when the hot-rolled steel sheet H is wound at constant tension by the coiler 4, the tensile stress T acts on the hot-rolled steel sheet H on a surface of the coil C as illustrated in FIG. 6 and FIG. 7, but the compressive stress S acts on the hot-rolled steel sheet H at an inner peripheral portion of the coil C near the mandrel 12.

(B) Besides, a general hot-rolled steel sheet H has a crown such that the center portion in the width direction protrudes. When another hot-rolled steel sheet H with a crown is further wound over the hot-rolled steel sheet H having such a crown, the center portion of the inner hot-rolled steel sheet H and the center portion of the outer hot-rolled steel sheet H come into contact. Therefore, the larger compressive stress S acts on the center portion in the width direction than on the end portion at the inner peripheral portion of the coil C.

(C) In actual operation, the mandrel 12 waits for the hot-rolled steel sheet H to be conveyed at a standby diameter, and when the predetermined number of windings of the hot-rolled steel sheet H is wound on the mandrel 12, the diameter is further expanded (over-expanded). When a pushing force of the cylinder portion 24 to expand the mandrel 12 is balanced with a surface pressure from the coil C, the expansion stops and the mandrel 12 maintains a constant diameter. However, in reality, a tight-winding force becomes excessive due to tension during the winding of the hot-rolled steel sheet H, a sheet thickness of the hot-rolled steel sheet H, a frictional force between the hot-rolled steel sheets H, and other factors, and the pushing force of the cylinder portion 24 is defeated, and the diameter of the mandrel 12 gradually contracts from a point when the tight-winding is completed. This diameter reduction of the mandrel 12 causes the hot-rolled steel sheet H at the inner peripheral portion of the coil C to have to take the compressive tight-winding force that the mandrel 12 should have taken.

Figure 8:
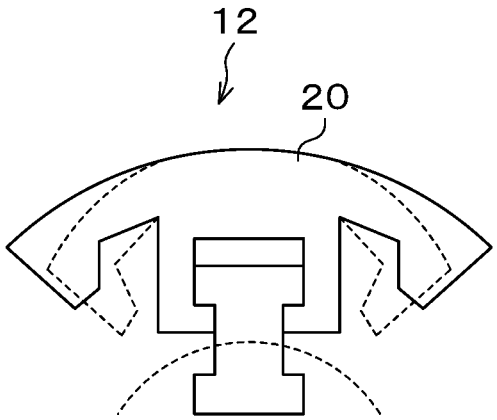
FIG. 8 is an explanatory diagram illustrating deformation of a mandrel segment due to the compressive stress.
Figure 9:
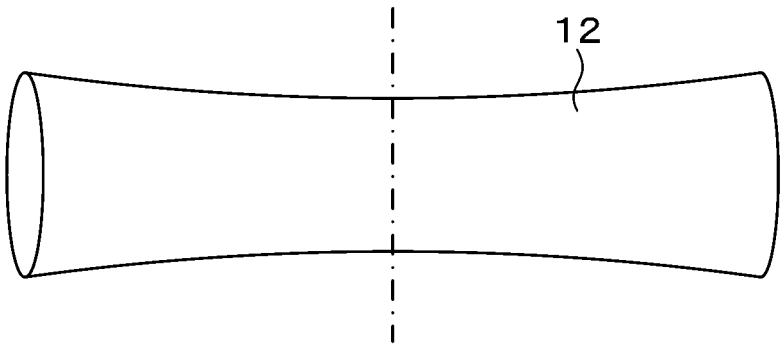
FIG. 9 is an explanatory diagram illustrating the deformation of the mandrel due to the compressive stress.

(D) When the above phenomena overlap, the compressive stress S in a sheet-passing direction (circumferential direction) increases at the inner peripheral portion of the coil C, especially at the center portion in the width direction, and as a result, the compressive stress S in a radial direction acting on a surface of the mandrel 12 increases. As illustrated in FIG. 4, the mandrel 12 has four mandrel segments 20 (segment-wedge portions 27), and as illustrated in FIG. 7, the compressive stress S in the radial direction acts equally on these mandrel segments 20. Then, as illustrated in FIG. 8, since each mandrel segment 20 is in a cantilevered state, the mandrel segment 20 is deformed (dotted lines in the drawing) and cannot receive the radial compressive stress S uniformly. Furthermore, as illustrated in FIG. 7, the compressive stress S generated in the radial direction is smaller at the end portion than at the center portion in the width direction, so a deflection amount of the mandrel segment 20 is also smaller at the end portion than at the center portion in the width direction. As a result, as illustrated in FIG. 9, a geometric peripheral length difference in the width direction is generated at the mandrel 12, and the diameter of the mandrel 12 becomes smaller at the center portion than at the end portion in the width direction. Then, the hot-rolled steel sheet H is wound in a coiled state on the mandrel 12 in such a deformed state. Since this winding is operated in a hot state, compressive plastic deformation, transformation plastic deformation, and creep deformation occur at the center portion in the width direction, and a shape is frozen. Thus, the flatness deterioration (ear wave) occurs in the hot-rolled steel sheet H.

<Method for Improving Flatness in the Present Embodiment>

The above is the mechanism of the flatness deterioration of the hot-rolled steel sheet, and the inventors found that the flatness deterioration is caused by the combination of the temperature factor and the tight winding factor. As described above, the flatness deterioration due to the temperature factor has been known in the past, and countermeasures have been taken. Concretely, it is possible to improve the flatness of the hot-rolled steel sheet by controlling the temperature distribution in the width direction to be uniform using, for example, an edge heater installed prior to the finishing mill or an edge mask installed in the cooling device. Therefore, the present invention improves the flatness of the hot-rolled steel sheet, which is worsened by the tight winding factor.

As mentioned above, the peripheral length difference in the width direction is generated at the mandrel due to the tight winding factor. Therefore, the inventors decided to reduce the peripheral length difference caused by the tight winding factor by giving the mandrel a protruding profile in advance. By reducing the peripheral length difference of the mandrel in this way, the flatness of the hot-rolled steel sheet can be improved at the inner peripheral portion of the coil wound on the mandrel. Concretely, by making the mandrel protrude, a medium wave is intentionally generated at the center portion in the width direction of the hot-rolled steel sheet, thereby improving an ear wave and increasing the flatness of the hot-rolled steel sheet. The inner peripheral portion of the coil is a range of 200 in from a tip of the hot-rolled steel sheet, where the flatness of the hot-rolled steel sheet has deteriorated in the past. In actual operation, experience has shown that the shape of the hot-rolled steel sheet wound on the coil becomes flat in the range of 200 in or further from the tip. This is probably because tension is generated at the hot-rolled steel sheet when the tip of the hot-rolled steel sheet reaches the mandrel, and the shape is corrected.

Figure 10:
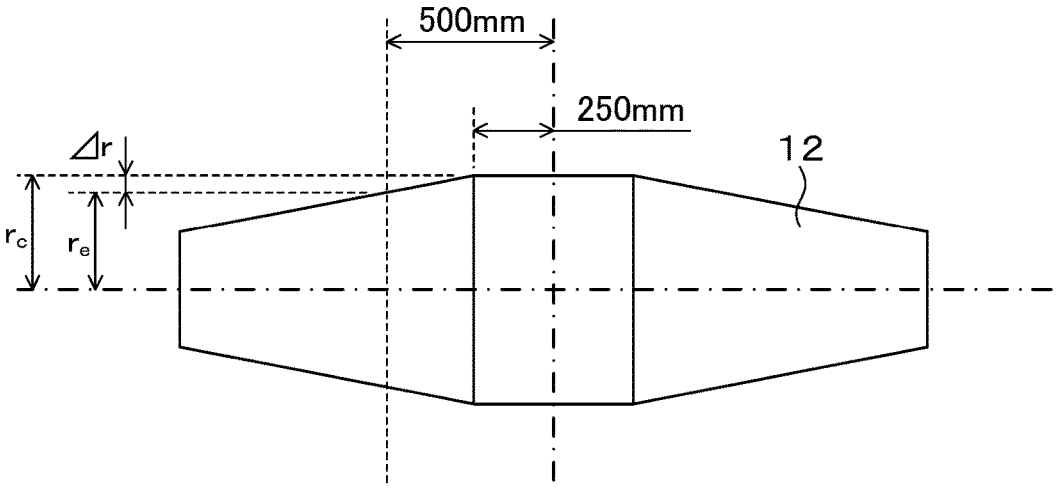
FIG. 10 is an explanatory diagram illustrating an outline of a configuration of the mandrel according to the embodiment.

FIG. 10 is an explanatory diagram illustrating an outline of a configuration of the mandrel of this embodiment. The mandrel has a protruding shape with the center portion in the width direction protruding than both end portions when seen from a lateral side in an axial direction. FIG. 10 also illustrates parameters: a reference radius $r_c$; an evaluation radius $r_e$; and a radius difference $\Delta r$, which determine a profile of this protruding shape. The reference radius $r_c$ is the radius at the center portion in the width direction (reference position). The evaluation radius $r_e$ is the radius at a position 500 mm from the center portion (evaluation position). The radius difference $\Delta r$ is the difference between the reference radius $r_c$ and the evaluation radius $r_e$ ($\Delta r = r_c - r_e$). In an example illustrated in FIG. 10, the protruding shape is a trapezoidal shape, and when seen from the lateral side, a surface is flat up to 250 mm from the center portion, and the diameter contracts from the 250 mm position to the end portion. In the present invention, a position at a predetermined distance from the center portion, that is the evaluation position, is 500 mm from the center portion.

Figure 11:
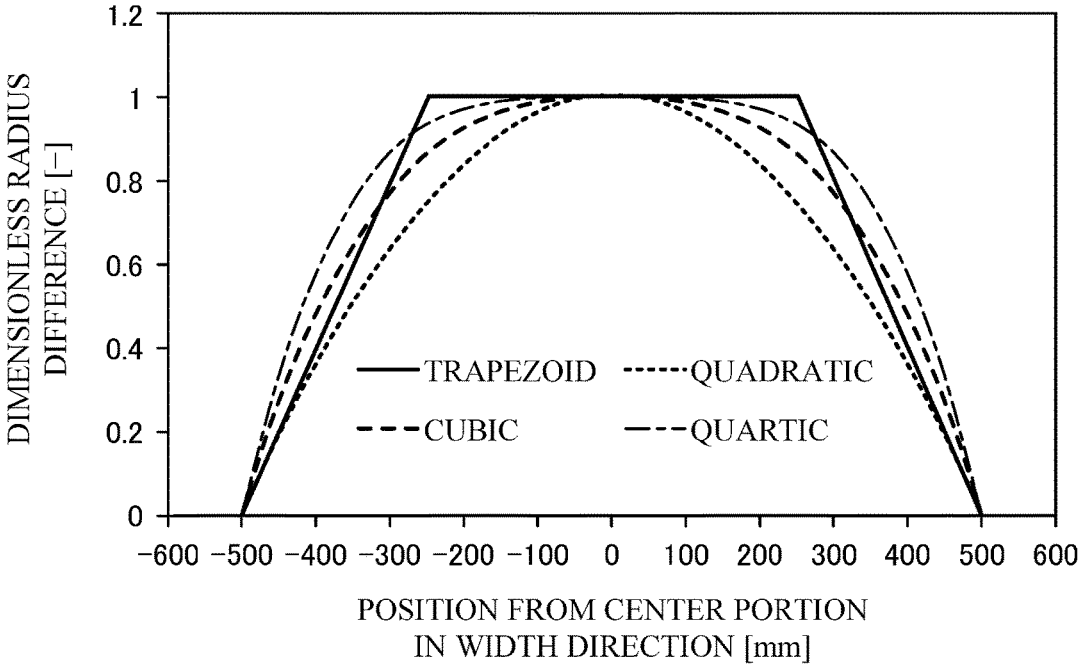
FIG. 11 is an explanatory diagram illustrating a protruding shape of the mandrel according to the embodiment.

As illustrated in FIG. 11, the protruding shape is not limited to the trapezoidal shape but can be, for example, a quadratic function shape, a cubic function shape, or a quartic function shape. A horizontal axis in FIG. 11 represents a position from the center portion in the width direction. A vertical axis represents a ratio of a difference ($r-r_e$) between a radius r and the evaluation radius $r_e$ at a predetermined position from the center portion in the width direction to the radius difference $\Delta r$. Concretely, it is a dimensionless radius difference calculated by $(r-r_e)/\Delta r$.

In determining the concrete profile of this protruding shape, the inventors conducted an experiment. In this experiment, a flat hot-rolled steel sheet with a sheet thickness of 3 mm and a sheet width of 1200 mm without a crown was wound in a coiled state by a mandrel. The tension at the time of winding was set at 20 MP and the number of windings was set at 100. The protruding shape of the mandrel was set to a trapezoidal shape, and steepness of the hot-rolled steel sheet at a representative point was measured by varying the peripheral length difference ratio, $\Delta r/r_c$, within a range of $0.0002<\Delta r/r_c<0.08$. The mandrel peripheral length difference ratio is calculated by dividing the difference between the peripheral length at the reference position (center portion in the width direction) and the peripheral length at the evaluation position (500 mm position) by the peripheral length at the reference position; concretely, it is calculated by $\Delta r/r_c$ because the peripheral length and radius are proportional. The mandrel peripheral length difference ratio can also be said to be a ratio of the elongation-strain difference of the hot-rolled steel sheet.

Figure 12:
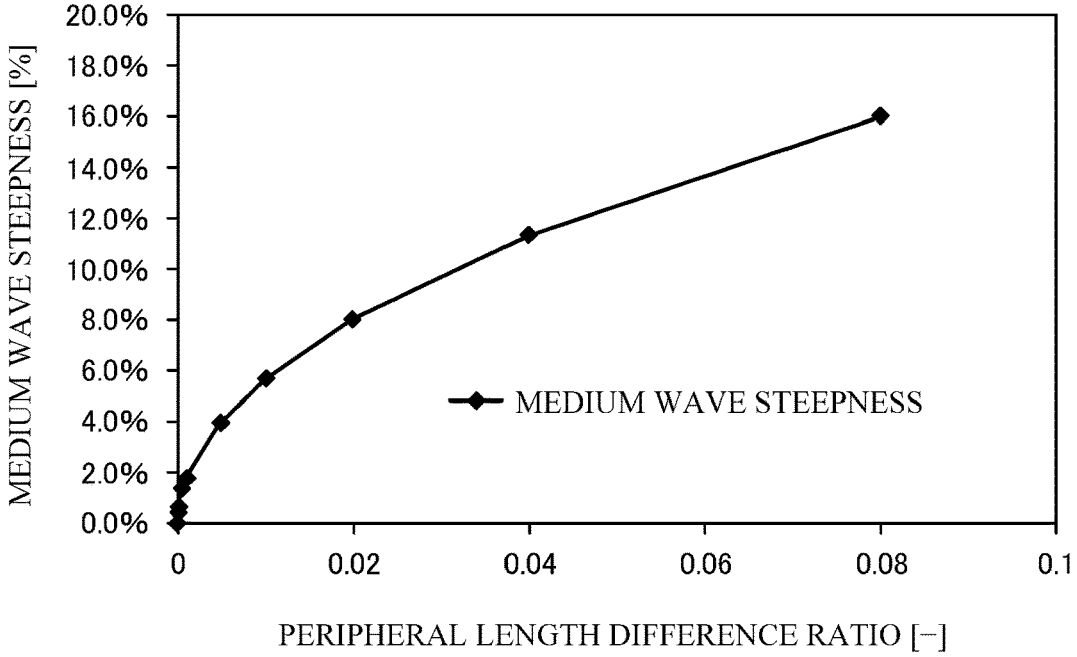
FIG. 12 is a graphic chart illustrating steepness of a medium wave of a hot-rolled steel sheet against a peripheral length difference ratio.

FIG. 12 is a graphic chart illustrating steepness of a medium wave of the hot-rolled steel sheet against the peripheral length difference ratio. A horizontal axis in FIG. 12 represents the peripheral length difference ratio. A vertical axis represents the steepness of the medium wave generated in the hot-rolled steel sheet at an innermost periphery of the coil. It can be seen that as the peripheral length difference ratio changes from 0.0002 to 0.08, the steepness of the medium wave increases from 0.8% to 16%. Therefore, increasing the peripheral length difference ratio of the mandrel can increase the medium wave generated in the hot-rolled steel sheet, and as a result, the ear wave can be improved and the flatness of the hot-rolled steel sheet can be improved.

Figure 13:
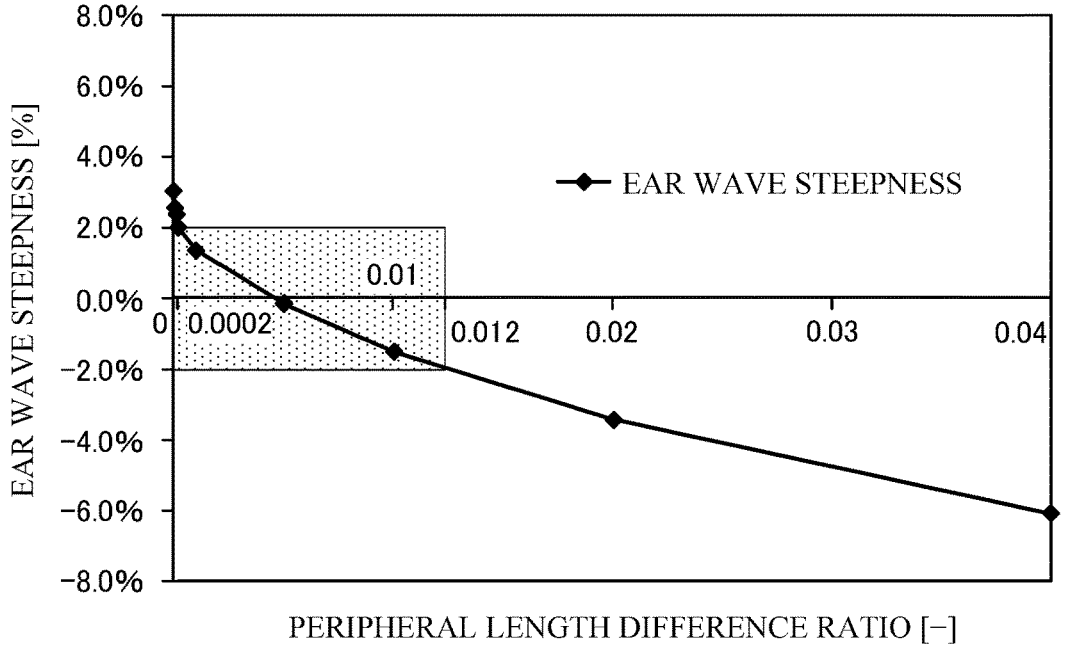
FIG. 13 is a graphic chart illustrating steepness of an ear wave of the hot-rolled steel sheet against the peripheral length difference ratio.

FIG. 13 is a graphic chart illustrating steepness of the ear wave of hot-rolled steel sheet against the peripheral length difference ratio. A horizontal axis in FIG. 13 represents the peripheral length difference ratio. A vertical axis represents the steepness of the ear wave generated in the hot-rolled steel sheet at the innermost periphery of the coil. When the peripheral length difference ratio is 0 (zero), as in the conventional case, the steepness of the ear wave generated in the hot-rolled steel sheet is 3%, based on past results. FIG. 13 also indicates that the steepness of the ear wave is 3% when the peripheral length difference ratio is 0 (zero). On the other hand, the steepness at which the hot-rolled steel sheet can be said to be sufficiently flattened as a product is 2% or less. Therefore, the peripheral length difference ratio $\Delta r/r_c$ should be $0.0002<\Delta r/r_c<0.012$ (shaded area in the drawing), according to the graphic chart in FIG. 13 to keep the steepness in a range of −2% to 2%. The peripheral length difference ratio of 0.0002 corresponds to 2% ear wave steepness, and the peripheral length difference ratio of 0.012 corresponds to −2% ear wave steepness.

Besides, for example, the peripheral length difference ratio $\Delta r/r_c$ may be $0.001<\Delta r/r_c<0.010$ to make the steepness in the range of −1.8% to 1.8% from the graphic chart in FIG. 13, from the viewpoint that the hot-rolled steel sheet should be flatter as a product. More preferably, $\Delta r/r_c$ may be $0.002<\Delta r/r_c<0.008$ to make the steepness in the range of −1.5% to 1.5%.

Furthermore, the inventors have verified that the protruding shape is not limited to the trapezoidal shape as in this experiment, but other quadratic function shapes, cubic function shapes, and even quartic function shapes can enjoy the same effect as above if the peripheral length difference ratio $\Delta r/r_c$ is set to $0.0002<\Delta r/r_c<0.012$.

As mentioned above, in addition to the tight winding factor, there is also the temperature factor that contributes to the flatness deterioration. In this experiment, it is assumed that the flatness deterioration due to this temperature factor has been improved by using, for example, the edge heater or edge mask.

As described above, if the mandrel has the protruding shape, the flatness of the hot-rolled steel sheet can be improved, and if the peripheral length difference ratio $\Delta r/r_c$ is set to $0.0002<\Delta r/r_c<0.012$, the flatness of the hot-rolled steel sheet can be further improved within the range of −2% to 2%. The flatness can be improved to a level where the coil does not need to be conveyed to a precise process for shape correction. As a result, a manufacturing cost can be lowered, and a manufacturing period can be stably shortened. Besides, defects that occur on a surface of the hot-rolled steel sheet in the precise process can be suppressed, and an yield of the product can be improved.

<Target Hot-Rolled Steel Sheet>

The flatness improvement method according to the present invention described above is particularly useful when the hot-rolled steel sheet to be wound with the mandrel is non-transformed or undergoing transformation. For example, if the hot-rolled steel sheet is wound after the transformation is completed, the shape of the hot-rolled steel sheet does not deteriorate more than when it is wound. On the other hand, if the hot-rolled steel sheet to be wound on the mandrel is non-transformed or undergoing transformation, the hot-rolled steel sheet may be further deformed. In this respect, if the mandrel is made to protrude in advance as in the present invention, the flatness of the hot-rolled steel sheet can be improved even if the hot-rolled steel sheet is non-transformed or undergoing transformation.

For example, when the hot-rolled steel sheet is wound at a high temperature of 700° C. or higher after the transformation is completed, the hot-rolled steel sheet may be deformed due to a creep phenomenon. Therefore, the flatness improvement method of the present invention is also useful in cases where the creep phenomenon occurs during such high-temperature winding.

Dimensions of the hot-rolled steel sheet to which the flatness improvement method of the present invention is applied are not particularly limited, but it is useful, for example, for the hot-rolled steel sheet with a sheet thickness of 1.4 mm to 6.0 mm and a sheet width of 600 mm to 1800 mm.

The embodiments of the present invention have been described above, but the present invention is not limited to such examples. It should be understood that various changes and modifications are readily apparent to those skilled in the art to which the present invention belongs within the scope of the technical idea as set forth in claims, and those should also be covered by the technical scope of the present invention.

INDUSTRIAL APPLICABILITY

The present invention is useful when a hot-rolled steel sheet is wound by a mandrel in a hot-rolling process to manufacture a coil.

EXPLANATION OF CODES

1 . . . hot-rolling facility
2 . . . finishing mill
3 . . . cooling device
4 . . . coiler
5 . . . run-out table
6 . . . sheet-thickness gauge
10 . . . pinch roll
11 . . . chute
12 . . . mandrel
13 . . . wrapper roll
20 . . . mandrel segment
21 . . . wedge
22 . . . slide rod
23 . . . wedge shaft
24 . . . cylinder portion
25 . . . segment flange portion
26 . . . wedge jaw portion
27 . . . segment-wedge portion
C . . . coil
H . . . hot-rolled steel sheet

What is claimed is:

1. A manufacturing apparatus of a hot-rolled coil which manufactures a coil by winding a hot-rolled steel sheet with a mandrel in a hot-rolling process, comprising:

the mandrel having a protruding shape with a center portion in an axial direction protruding from both end portions when seen from a lateral side in the axial direction, wherein regarding a peripheral length difference, which is a difference between a peripheral length of the center portion and a peripheral length at a predetermined distance from the center portion, the ratio of the peripheral length difference to the peripheral length of the center portion is 0.0002 to 0.012.

2. The manufacturing apparatus of the hot-rolled coil according to claim 1, wherein the ratio of the peripheral length difference to the peripheral length of the center portion is 0.002 to 0.008.

3. The manufacturing apparatus of the hot-rolled coil according to claim 2, wherein the protruding shape is a trapezoidal shape or a polynomial function shape.

4. A manufacturing method of a hot-rolled coil, which uses the manufacturing apparatus according to claim 3, comprising:

winding a hot-rolled steel sheet, which is non-transformed or undergoing transformation, or after the completion of transformation and is at a temperature of 700° C. or higher, with the mandrel to manufacture the coil.

5. A manufacturing method of a hot-rolled coil, which uses the manufacturing apparatus according to claim 2, comprising:

winding a hot-rolled steel sheet, which is non-transformed or undergoing transformation, or after the completion of transformation and is at a temperature of 700° C. or higher, with the mandrel to manufacture the coil.

6. The manufacturing apparatus of the hot-rolled coil according to claim 1, wherein the protruding shape is a trapezoidal shape or a polynomial function shape.

7. A manufacturing method of a hot-rolled coil, which uses the manufacturing apparatus according to claim 6, comprising:

winding a hot-rolled steel sheet, which is non-transformed or undergoing transformation, or after the completion of transformation and is at a temperature of 700° C. or higher, with the mandrel to manufacture the coil.

8. A manufacturing method of a hot-rolled coil, which uses the manufacturing apparatus according to claim 1, comprising:

winding a hot-rolled steel sheet, which is non-transformed or undergoing transformation, or after the completion of transformation and is at a temperature of 700° C. or higher, with the mandrel to manufacture the coil.

* * * * *